United States Patent [19]

Horwitt

[11] 4,007,353

[45] Feb. 8, 1977

[54] ELECTRICAL IGNITING UNIT HAVING SPIRAL RESISTANCE COIL

[75] Inventor: Laurence G. Horwitt, New Haven, Conn.

[73] Assignee: Sun Chemical Corporation, New York, N.Y.

[22] Filed: Aug. 17, 1976

[21] Appl. No.: 715,148

[52] U.S. Cl. ..... 219/270; 219/552

[51] Int. Cl.[2] ..... F23Q 7/22

[58] Field of Search ..... 219/260, 265, 267, 270, 219/536, 541, 552; 317/98

[56] References Cited

UNITED STATES PATENTS

| | | | |
|---|---|---|---|
| 2,062,701 | 12/1936 | Cohen | 219/270 |
| 3,573,428 | 4/1971 | Deming | 219/265 |
| 3,892,944 | 7/1975 | Horwitt et al. | 219/270 |
| 3,909,587 | 9/1975 | Mattis | 219/270 |
| 3,958,099 | 5/1976 | Mattis | 219/270 |

*Primary Examiner*—Volodymyr Y. Mayewsky
*Attorney, Agent, or Firm*—Cynthia Berlow

[57] ABSTRACT

An electrical igniting unit for cigar lighters, engine ignitor plugs, and the like comprising a wound spiral of resistance ribbon which is carried in a shallow metal cup to span the mouth thereof. The inner end of the ribbon is secured to a metal stud as by crimping and/or welding it in a slotted head thereof. The outer coil convolution is secured to the rim of the cup by forming inward the rim edge into a tight curl which is laid over on the end portion of the coil convolution. A relatively large area of the coil end is thus tightly and securely pinched under continual pressure, to establish a low-resistance effective mechanical and electrical connection between the cup and the coil. The metal cup is made of steel, and in order to solve the problems of destructive cracking of the cup wall or peeling of plating, as well as rusting and pitting of the wall where it engages the cooperable electrical contacts, the cups are mass heat treated by a low-temperature nitriding process which causes a shallow penetration of from 0.0002 inch to roughly 0.0006 inch. Such nitriding does not impair the ability of the cup wall to be inwardly curled without destructive cracking while at the same time it provides a protective coating which is resistant to abrasion, corrosion and the like, although still retaining satisfactory electrical conducting characteristics. satisfactory

3 Claims, 4 Drawing Figures

Fig. 3
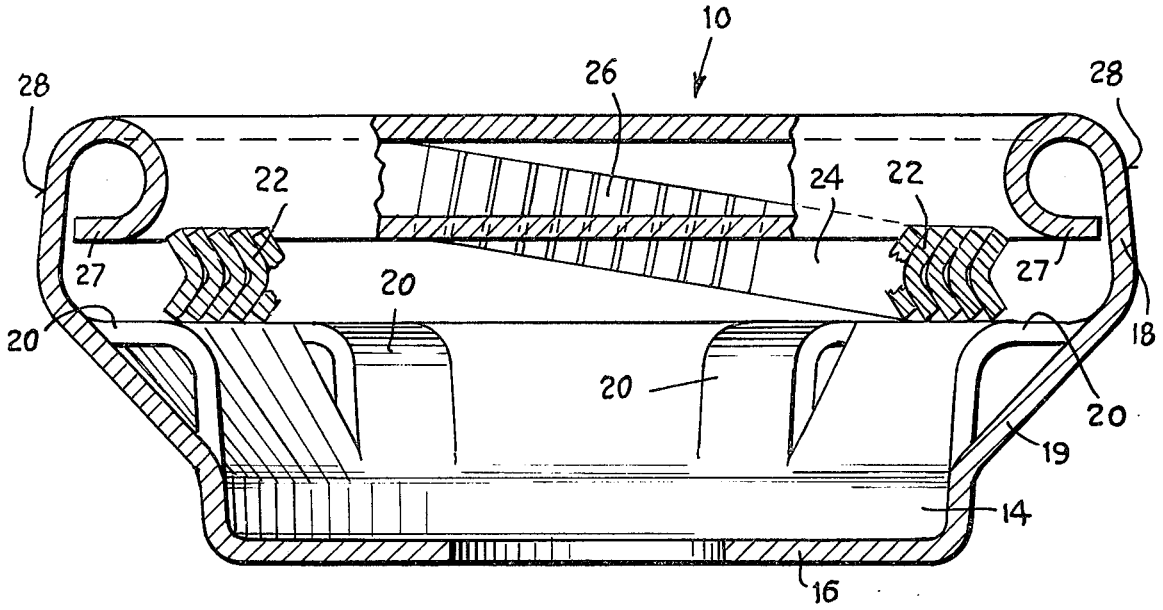
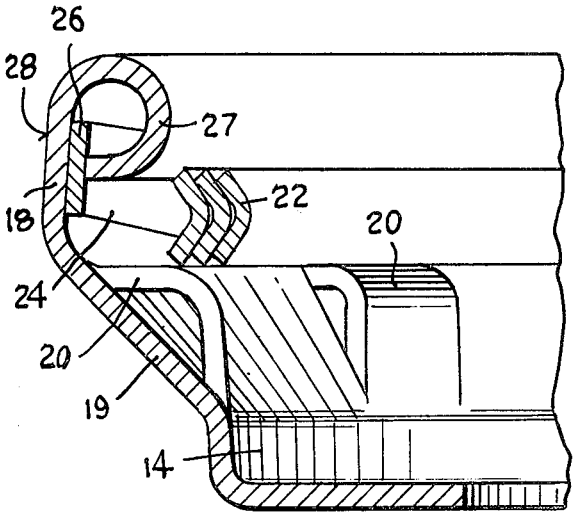
Fig. 4

ELECTRICAL IGNITING UNIT HAVING SPIRAL RESISTANCE COIL

BACKGROUND OF THE INVENTION

The present invention relates to electric cigar lighter heating elements of the type disclosed and claimed in Mattis U.S. Pat. No. 3,958,099. In the past, covering a considerable period of years, the design and manufacture of heating element units for cigar lighters have undergone change not so much in the form of substantial innovations as in the form of relatively minor improvements directed toward enhancing the quality of the product and reducing its cost.

For many years a standardized form of cigar lighter heating element consisted of a flat ribbon which was wound into a pancake spiral and then supported in a metal cup, with the outermost convolution of the ribbon being welded to the inside surfaces of the cup wall. The cups were uniformly made of steel stampings, and to overcome problems of poor contact, abrasion, etc. where the rims of the cups were latched onto by the bimetallic circuit-breaking fingers, the cups were plated as with nickel, chrome, gold, silver and the like.

For the purpose of combating abrasion, the cups were case hardened with a deeply penetrating nitriding process, as by heating them in an atmosphere of ammonia gas. Thereafter, the cups were cleaned as by tumbling, and then plated with nickel, silver or other metal to prevent rusting and corrosion, especially at the contacting outer rim surfaces where engagement occured with the bimetallic latching fingers.

The above case hardening procedure which was followed by nickel plating found wide acceptance. Previously, the use of gold plating or silver plating resulted ultimately in the wearing away of the plated metal and a consequent rusting and deterioration of the cup surface, even though no appreciable deep abrasion occurred because of the case hardening treatment.

One disadvantage of the deep case hardening involved possible distortion of the stamped and drawn cup, which could result in malfunctioning and required careful checking to assure uniformity in the end product.

The various changes in the design and manufacture of heating element cups did not occur quickly, but instead the improvements were made over the years as a result of extensive testing and inspection after thousands of operations of the cigar lighter in the intended manner.

Recently an important innovation has been achieved in the manufacture of heating elements for cigar lighters and the like, as set forth in recently issued U.S. Pat. No. 3,958,099 dated May 18, 1976 and entitled "Electrical Resistance Unit For Ignitor Plugs", the inventor being Donald J. Mattis. This innovation enabled the welding procedure to be eliminated completely, and further eliminated the sharp and irregular cut edge of the steel heating element cup, providing instead a uniform and attractive rolled-in edge which resulted in a highly desirable finished appearance with no sharp edges. The rounded or rolled-in edge was done in such a manner that it crimped and securely held the outermost end of the spiral heating ribbon contained in the cup. The rolling-in of the edge not only eliminated the costly welding procedure with its consequent inspection and spot-checking, but it also enabled an automated assembly of the heating element to the cup to be effected, in a quicker and more economical manner. At the same time, the rolled-in edge provided an improved electrical connection which did not require subsequent inspection, spot-checking, etc.

In spite of the many advantages of the rolled-in edge which eliminated the welding there remained a problem with respect to the finish to be provided on the metal cup. It was not found possible to employ the usual case hardening and nickel plating for the reason that the cup wall would be too brittle, resulting in objectionable cracking while at the same time there was a strong tendency for the nickel plating to peel away during the curling-in process of the cup rim. In the environment used, the electrical heating elements require resistance to abrasion and rusting while also effecting a positive electrical contact capable of carrying the required electrical amperage. It was not immediately apparent how the problem could be solved without resorting to additional plating operations or the link which defeated the objective of providing a more economical unit and one which would lend itself to an automated assembly.

SUMMARY OF THE INVENTION

The above problems attendent to the improved heating element assemblage of the U.S. patent identified above are obviated by the present invention, which has for its main objective the provision of heating element unit for cigar lighters and other heating devices, wherein a steel cup containing the heating element can have its edge satisfactorily rolled-in to crimp the element while at the same time there is had resistance to abrasion and corrosion and an effective electrical contact adapted to stand up over many thousands of operations. Another object of the invention is to provide an improved heating element unit in accordance with the foregoing, which lends itself to automated, low-cost production and does not require subsequent plating or finishing procedures that would unduly increase the fabricating expense. The above objects are accomplished by an igniting unit construction characterized by a shallow steel cup in most respects similar to those commonly employed in conventional cigar lighter heating elements but having initially a deeper rim portion. A spiral wound heating coil is provided, for use in the cup but prior to its installation the cup is subjected to a low-temperature, salt-bath nitriding process which produces a surface hardening of relatively shallow, controlled penetration. The amount of nitriding, for example, can be to a depth of from 0.0002 inch to roughly 0.0006 inch. The steel cup is not plated, either before or after the nitriding. Upon being cleaned subsequent to the nitriding, the cup is assembled to the heating coil by the usual method of installing the latter, and thereafter the thin-walled edge of the cup is rolled inward so as to securely crimp a portion of the outer convolution of coil, effecting a tight mechanical and electrical connection thereto. The inner end of the heating coil is conventionally secured to a central contact and mounting stud or rivet, as by slitting the rivet head and pinching the coil end therein, and/or welding the coil end to the rivet.

The limited amount of nitriding readily enables the thin side wall of the cup to be fully crimped in a tight curl without objectionable cracking of the working areas of the metal. After assembly of the coil and cup, the initial heating of the coil produces a gun-metal blue color to the exterior of the cup; however, the nitrided exterior cup surface and blue color imparted thereto have been found to not adversely affect those electrical contact characteristics which are required for satisfactory cigar lighter operation. At the same time, the nitriding provides a high degree of abrasion and corrosion resistance whereby a completely satisfactory product is obtained. The low temperature nitriding of the cup is carried out in bulk, and the elimination of subsequent plating operations in conjunction with the elimination of welding of the outer coil convolution results in an advantageous, low-cost product which is at the same time characterized by superior performance.

Other features and advantages will hereinafter appear.

In the accompanying drawings:

FIG. 3 is an axial sectional view, greatly enlarged, of a heating element unit as provided by the invention, taken at the near side of a pair of diametrically opposite lanced support shoulders, and FIG. 4 is a fragmentary axial sectional view of the heating element unit, taken on the line 4—4 of FIG. 2.

Figure 1:
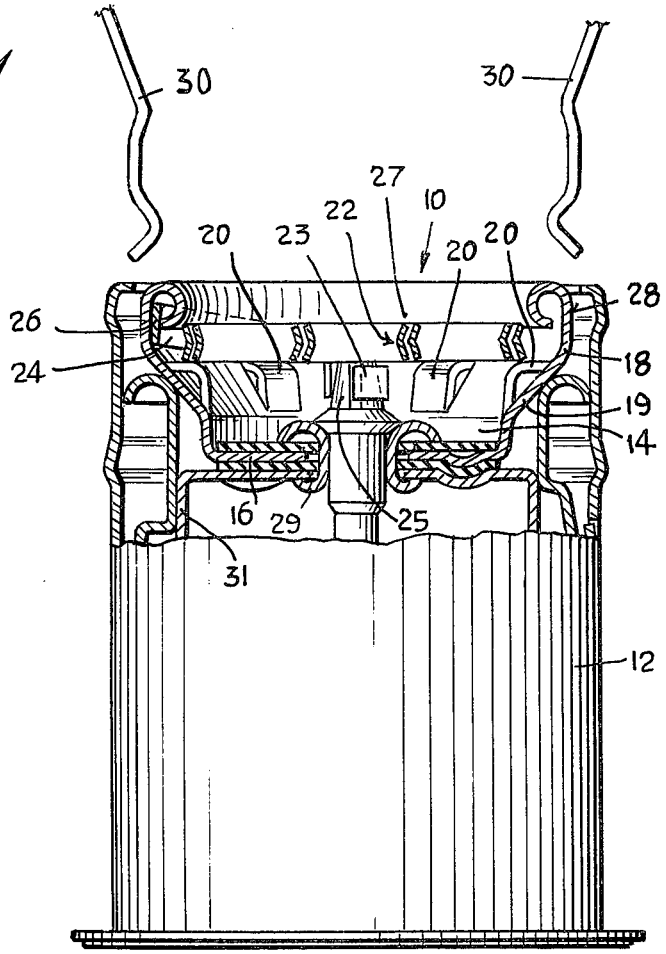
FIG. 1 is a fragmentary view partly in side elevation and partly in axial section, of a cigar lighter igniting unit plug having incorporated in it the improved heating element unit of the invention. Also shown are bimetallic contact clips of a cigar lighter holder device, for cooperation with the heating element cup.
Figure 2:
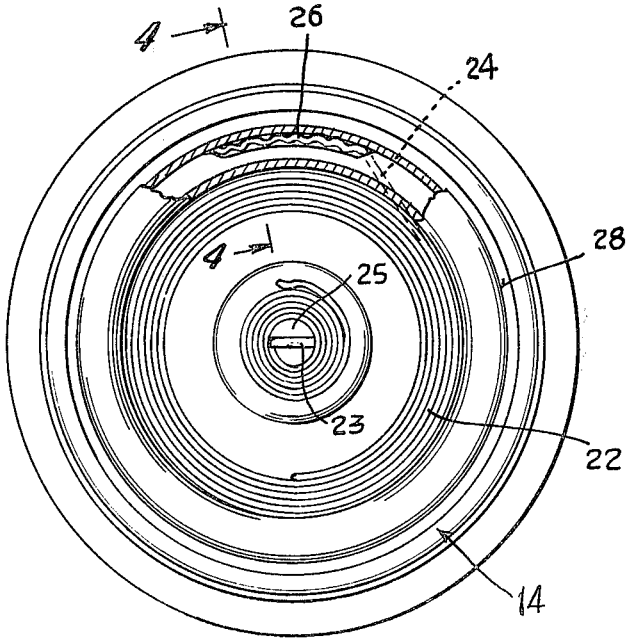
FIG. 2 is an inner end elevational view of the igniting unit of FIG. 1, with a portion of the inwardly crimped cup rim broken away to reveal additional details.

Referring first to FIG. 1 there is shown an igniting unit plug designated generally by the numeral 10, having a friction sleeve 12 in which is movably a shallow steel heating element cup 14. The cup 14 comprises a transverse or bottom wall 16 and a thin annular side wall 18, the latter constituting what is herein termed the rim portion of the cup. Between the transverse wall 16 and the side wall 18 there is a conical side wall portion 19 in which there are formed inwardly lanced support shoulders 20. The shoulders 20 constitute shelves against which there rests a spiral-wound heating element coil 22 constituted of metal alloy resistance ribbon. A portion 24 of the outermost convolution of the heating element coil 22 is off-set radially outward from the remainder of the coil, and an arcuate extremity 26 of such off-set portion is tightly clamped by an inward curl or crimp 27 which is formed from the rim portion 18 of the cup 14. The inward curl 27 can be formed in a quick stamping operation by a suitable punch which curls inward the edge to the configuration illustrated.

The innermost convolution 23 of the heating coil 22 is secured in the slotted head 25 of a central mounting stud of usual construction, which anchors the inner coil portion to an eyelet 29 that attaches the cup 14 to the igniting plug body 31.

In accordance with the present invention that steel cup 14 is given a low-temperature low-penetrating nitriding, which results in a low-penetration nitriding surface 28 on the exterior of the annular wall 18 which is adapted for engagement with the bimetallic clip fingers 30 (FIG. 1) of the cigar lighter holder device. In carrying out the low-temperature low-penetration nitriding, it is practical to nitride the entire steel cup 14 in large quantities (in bulk). I have found, contrary to expectations, that such low temperature nitriding does not impair the ability of the rim portion 18 of the cup to be curled inward, and that there is no objectionable or destructive cracking of the metal due to the inward curling. Moreover, the low-temperature nitriding does not appreciably impair the electrical contact between the cup 14 and the bimetallic fingers 30 to the extent of detracting from the operation of the cigar lighter, while at the same time it imparts a surface hardness to the cup which resists abrasion and also corrosion. After the first or initial heating of the heating element 22, the surface of the cup 14 is characterized by a gun-metal blue finsih or color which does not impair the electrical contact with the bimetal fingers 30 to render the cigar lighter inoperative even after many thousands of repeat operations.

Low-temperature, low-penetration salt-bath nitriding as employed by the invention herein can be according to the process set forth in an article appearing in Machinery Magazine for October 1973 by Edward Taylor, Manager of Technical Services, Tufftride Division of Kolene Corporation, Detriot, Mich. The information contained in this article is made a part of the present disclosure, and is readily available to the trade. The salt-bath nitriding process described therein is carried out at a temperature of 1060° F–570° C, and enables stampings to be heat-treated with no resulting distortion. Moreover, the process produces a hard, wear-resistant surface, while the part retains the capability of working, such as forming, stamping, rolling-in edges, etc. The nitrided surface, moreover, exhibits the property of lubricity which adapts it well to use in the treatment of heating element cups for cigar lighters, involving the electrical contact and mechanical detent function of the bimetallic clip fingers of these devices.

Another article dealing with low-temperature nitriding as employed by the present invention appeared in a paper given by Robert H. Shoemaker of the Kolene Corporation, at the Automotive Engineering Congress and Exposition of the Society of Automotive Engineers in Detroit, Mich. on Feb. 24–28, 1975, the information of which is also made a part of the present disclosure.

Thus, by the low temperature nitriding of the steel cup 14 the invention solves the difficult problem heretofore encountered, of mass producing heating element units embodying shallow steel cups with coil-crimping rims, without resorting to expensive refinishing operations of the cup contact surfaces. Where attempts were previously made to curl inward a steel cup after it was plated, it was found that the plating did not withstand the curling or crimping but tended to peel off and expose the bare steel which would then corrode. The usual high temperature or deep penetration nitriding process to which steel heating element cups were heretofore subjected was not suitable since the hardness imparted to the cup walls prevented any inward curling without extensive or objectionable cracking, which curling eliminated the expensive prior welding procedure.

From the foregoing it will be seen that, by the one simple operation of subjecting the cups to low temperature nitriding prior to assembly with the heating coil, I have solved the problems of cracking of the cup wall during crimping, peeling off of the plating, maintenance of good electrical contact with the bimetal clip fingers, and resistance to corrosion, pitting and so forth as well as resistance to abrasion. The improved heating element of the invention enables a truly low-cost, high-production automated operation to be utilized which greatly reduces the cost while at the same time providing a product of superior performance which meets all of the rigorous standards of the industry.

Variations and modifications are possible without departing from the spirit of the invention.

I claim:

1. An electrical igniting unit for use with the holders of cigar lighters, comprising in combination:

a. a shallow metal cup having a relatively thin annular side wall, b. a coiled heating resistance element disposed in said cup and having an outer end juxtaposed to and extending along the side wall thereof, c. the entire edge of the side wall of the cup being inwardly crimped over and firmly sandwiching said outer end of the heating element whereby said end is both permanently mechanically secured to the side wall and electrically connected thereto, d. means carried by the cup, providing an electrical connection to the inner end of the heating element, the outer annular wall surface of the cup being adapted for engagement with a cooperable metal electrical contact of an igniting unit holder whereby a complete circuit can be established through the heating element, e. said outer wall surface of the cup being nitrided by subjecting the entire cup to a low temperature nitriding process.

2. An electrical igniting unit as set forth in claim 1, wherein the outer surface of the cup is nitrided to a depth of from 0.0002 inch to 0.0006 inch.

3. An electrical igniting unit as in claim 1, wherein:

a. the outer surface of the cup has a blue-black gun metal finish effected by subjecting the cup to heat after the nitriding thereof.

* * * * *